US006431356B2

(12) United States Patent
McNeill

(10) Patent No.: US 6,431,356 B2
(45) **Date of Patent: *Aug. 13, 2002**

(54) METHOD OF PACKAGING BICYCLES FOR SHIPMENT

(75) Inventor: Mark McNeill, Fountain Valley, CA (US)

(73) Assignee: Motiv Sports, Inc., Anaheim, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/805,603

(22) Filed: Mar. 13, 2001

Related U.S. Application Data

(62) Division of application No. 09/448,715, filed on Nov. 24, 1999.

(51) Int. Cl.[7] ..... B25D 85/68
(52) U.S. Cl. ..... 206/335
(58) Field of Search ..... 206/335, 445, 206/449, 529

(56) References Cited

U.S. PATENT DOCUMENTS

| | | | | |
|---|---|---|---|---|
| 2,183,177 | A | 12/1939 | Van Saun | |
| RE22,305 | E | 4/1943 | Van Saun | |
| 3,886,988 | A | 6/1975 | Garrett et al. | |
| 3,929,225 | A | 12/1975 | Locke et al. | |
| 4,991,715 | A | 2/1991 | Williams et al. | |
| 5,669,497 | A | 9/1997 | Evans et al. | |
| 6,267,237 | B1 * | 7/2001 | McNeill | 206/335 |

* cited by examiner

*Primary Examiner*—David T. Fidei
(74) *Attorney, Agent, or Firm*—Knobbe, Martens, Olson & Bear, LLP

(57) ABSTRACT

An improved method of packaging bicycles for transport or retail is disclosed which involves a minimum of disassembly before packaging. The front wheel is removed and secured alongside the frame with a packing disk between to keep the frame and wheel from contacting. The wheel is affixed to the frame to reduce movement. The right pedal is removed, wrapped, and affixed to the bicycle. The left pedal is moved to the lowermost position, out of the way of the front wheel. The handle bars are turned and affixed in a position parallel to the frame, requiring the packaging to have a minimum width. The derailleur is set to the furthest inside position. A fork insert is positioned on the fork to keep it from breaking through the packaging. This provides for the use of a minimum of wrapping materials while still protecting the bicycle. The positioning of the wheel, right crank arm, and handle bars takes up the least area and protects the frame because it never touches the box.

2 Claims, 5 Drawing Sheets

METHOD OF PACKAGING BICYCLES FOR SHIPMENT

RELATED APPLICATIONS

This application is a Divisional application of U.S. patent application Ser. No. 09/448,715, filed Nov. 24, 1999.

FIELD OF THE INVENTION

The present invention relates generally to a method of packaging bicycles for shipment. More specifically, the invention relates to a method of packaging bicycles with a minimum of disassembly.

BACKGROUND OF THE INVENTION

As a part of the retail and manufacturing process, many bicycles are assembled at a separate location from that of their sale. Therefore, bicycles are often manufactured, assembled, and tested at one point and then transported to the retail establishment for sale.

It is advantageous to the seller for the transport to be inexpensive and result in the least damage to the merchandise.

Previous methods have cut down on expense and damage by disassembling the bicycle to various extents in order to transport it in a smaller volume package, typically a box. This allows for the transport of the largest number of bicycles in the smallest volume. Wrapping and other types of protective materials are often used to reduce any damage that may occur during transport by the disassembled bicycle parts coming in contact. Of particular interest is to keep the paint from being scratched.

Although, this allows for inexpensive transport, it requires that the bicycles must be assembled by a technically trained employee when they reach the retail establishment. The seller must employ a skilled person to reassemble the bicycles which can increase expense significantly. Alternatively, the seller can hire a skilled outside contractor to assemble the bicycle, again increasing the expense. In addition, most contractors are minimally trained to assemble and repair bicycles. Often they are trained to assemble very different types of merchandise, such as barbecue ranges, and are prone to assembling the bicycles improperly, leading to product returns and liability claims.

Typically, bicycles are shipped in boxes with the saddle, the handlebars, the front wheel, and both pedals removed. The various bicycle parts are wrapped in protective material, such as foam and plastic, and placed separately in the box. A variety of other components, including the pedals, reflectors, kickstand etc. are placed in a smaller accessory box within the box. When the box reaches the retail store, the parts are removed from the box and reassembled. This leads to a number of possible problems. The parts can be lost when they are removed, the wrapping materials must be removed and disposed of. Lastly, the process of reassembly can be more complicated than it first appears.

Incorrect assembly can result in damage to the bicycle or consumer dissatisfaction, resulting in the merchandise being returned. Typically, the pedals are attached to the bike by screwing them into a threaded opening in the bicycle crank arm. Insertion of the right pedal requires rotation clockwise, as is normally expected for this type of attachment. However, insertion of the left pedal requires rotation counterclockwise. This is to insure that during the process of riding the bike and rotating the pedals, they will not be loosened. Most untrained people are not aware of this fact and the incidence of the threads of the left pedal being stripped during attachment of the left pedal is very high.

Although, this is a very common mistake, assembly of other parts can be equally complex. Reattachment of the handlebars can require a special tool and it is important that the handlebars be straight for proper handling. The rear wheel is particularly difficult because it requires removal of the chain from the gears, and removal of the tire. Once assembled, the derailleur and shift levers must be adjusted to work smoothly, the brakes and brake pads must be adjusted to be positioned on the rim without touching either the rim or the tire.

A second disadvantage to the transport of a significantly disassembled bicycle is the expense, waste, and mess that result from removal of the wrap required to protect the disassembled parts and keep them from touching or scratching the paint. Wrapping materials require clean-up and removal and are wasteful. This results in an added expense and is damaging to the environment.

Therefore, of interest, is a technique for transporting bicycles in a minimally disassembled state and protecting the bicycle parts while allowing for the least waste and environmental damage.

SUMMARY OF THE INVENTION

Accordingly, the present invention is a method of packaging bicycles in a maximally assembled state while still allowing for packaging in a small volume. The method further requires less wasteful wrapping while retaining protection of the bicycle parts. The method, therefore, minimizes losses due to damage during reassembly, loss of disassembled parts, the need for technically skilled labor to assemble the bicycle correctly, and returned products due to dissatisfied customers.

An unassembled or disassembled bicycle is understood to be defined as a bicycle which is not ready for riding ie: either never fully assembled, or assembled and then disassembled.

Accordingly, one aspect of the invention is a method of packing a bicycle in a box for shipment, by assembling a bottom bracket with right and left crank arms onto the bicycle, assembling the left pedal of the bicycle onto the bicycle by mounting the left pedal onto the left crank arm, placing the bicycle in a box with the left pedal abutting one side of the box, and placing the right pedal for the bicycle in the box but not mounted on the right crank arm.

A further aspect of the invention is a method of packing a bicycle in a box for shipment, by partially assembling the bicycle; and placing the bicycle in the box so that only one end of the handlebars, one pedal, one crank arm, the sidewall of one tire, the tread of the other tire, the end of the front forks and the seat contact the box.

A further aspect of the invention is a method of packing a bicycle in a box for shipment by partially assembling the bicycle; and placing the partially assembled bicycle in a box without protective wrapping on the frame of the bicycle, and without any portion of the frame in contact with the box.

A further aspect of the invention is a method of packing a bicycle in a box for shipment, by placing the bicycle in the box so that the front wheel and right crank arm of the bicycle contact opposite sides of the box.

Another aspect of the invention is a method of packing a bicycle in a box for shipment, by printing assembly instructions for the bicycle on a cardboard sheet; and sandwiching the cardboard sheet between the frame of the bicycle and the front wheel of the bicycle.

A further aspect of the invention is a method of packing a bicycle in a box for shipment, by partially assembling said bicycle, tying all parts of the bicycle not assembled thereto to the partially assembled bicycle to form an attached group; and placing the attached group into the box.

A further aspect of the invention is a bicycle packed in a box for shipment, comprising: a bicycle frame, a bottom bracket with right and left crank arms assembled in a proper, working configuration on the bicycle frame, a left pedal assembled in a proper, working configuration, on the left crank arm, a box surrounding the bicycle frame, one side of the box abutting the left pedal, and a right pedal in the box but not mounted on the right crank arm.

A further aspect of the invention is a bicycle in a box for shipment, comprising: a partially assembled bicycle, and a box surrounding the partially assembled bicycle so that only one end of the handlebars, one pedal, one crank arm, the sidewall of one tire, the tread of the other tire, the end of the front forks and the seat contact the box.

A further aspect of the invention is a bicycle in a box for shipment, comprising: a partially assembled bicycle having a frame, and a box holding the partially assembled bicycle without any portion of the frame in contact with the box.

A further aspect of the invention is a bicycle in a box for shipment, comprising: a bicycle frame, right and left crank arms assembled in a proper, working configuration onto the bicycle frame, one pedal, but not the other, assembled in a proper, working configuration onto the right and left crank arms, and a box surrounding the bicycle frame.

A further aspect of the invention is a partially assembled bicycle, comprising: a bicycle frame, a pedal attached to said bicycle frame in a proper, working configuration; and a second pedal, and all remaining parts of the bicycle not assembled thereto attached to the bicycle frame to form an attached group.

A further aspect of the invention is A bicycle packed in a box for shipment, comprising;

A bicycle frame, a bottom bracket with right and left crank arms assembled in a proper, working configuration on the bicycle frame, a left pedal assembled in a proper, working configuration, on the left crank arm, a box surrounding said bicycle frame, one side of the box abutting the left pedal, and a right pedal in the box but not mounted on the right crank arm.

A further aspect of the invention is a method of assembly of a partially assembled bicycle at the point of shipment delivery comprising: removing the partially assembled bicycle from the box in one piece, attaching the right pedal, attaching the front wheel, and selling the bicycle without further assembly or adjustment.

BRIEF DESCRIPTION OF THE DRAWINGS

These and other features, aspects and advantages of the present invention will now be described with reference to the drawings of the preferred embodiment, which embodiment is intended to illustrate and not to limit the invention, and in which.

DETAILED DESCRIPTION OF THE PREFERRED EMBODIMENT

Figure 1:
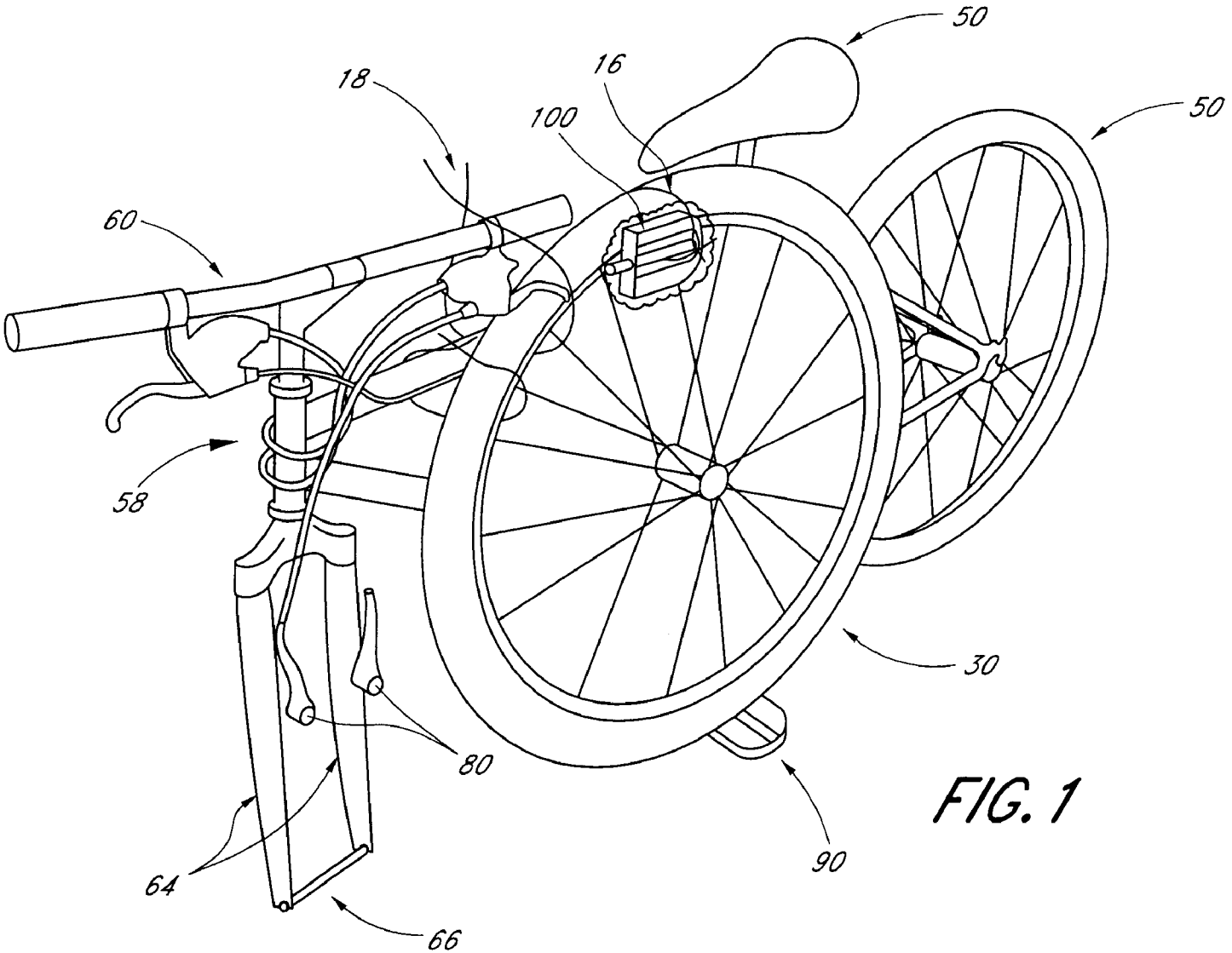
FIG. 1 is a isometric view of the bicycle ready for packaging in accordance with preferred embodiments of the present invention.
Figure 5:
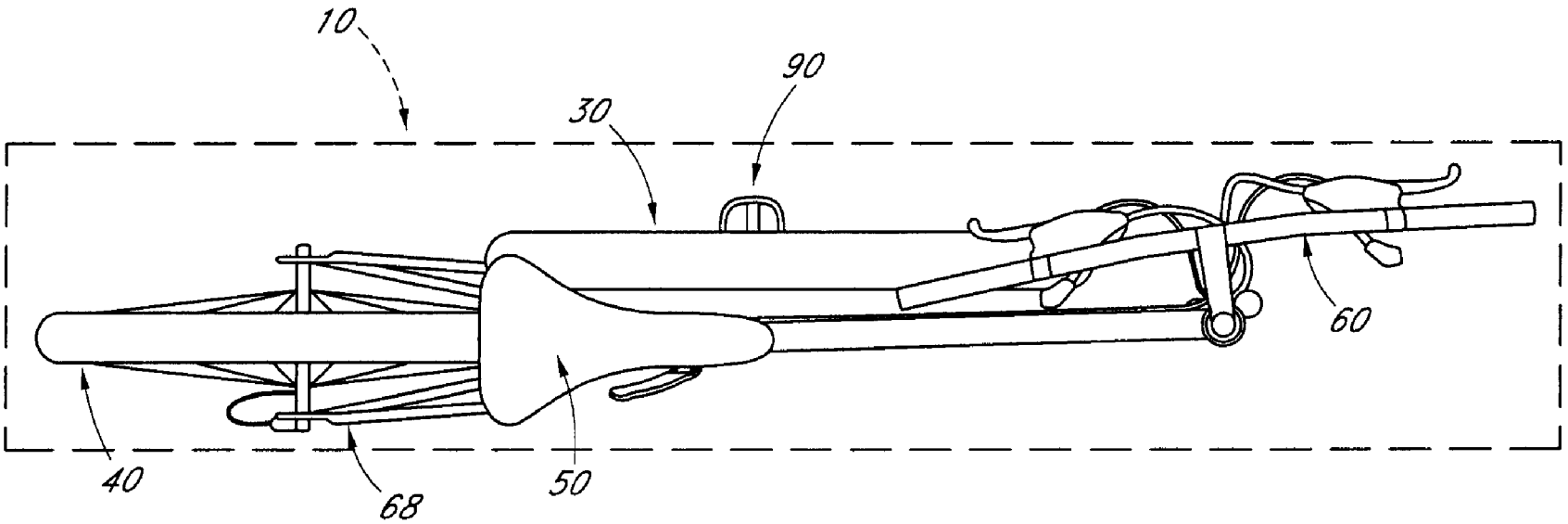
FIG. 5 is a plan view from above left of the bicycle packaged in accordance with the preferred embodiments of the invention.

With reference initially to FIGS. 1 and 5, a bicycle packaged using the method of the present invention, and designated by reference numeral 1, is illustrated. The method of packaging can be configured and arranged to accept bicycles and bicycle wheels of various sizes, weights, and configurations. For instance, the length, width, and height of the packaging can be adjusted to fit a tandem bicycle. Alternatively, a smaller package could be made for a children's bike or that bike can be inserted into the packaging for an adult-sized bicycle. While the method of packaging is generally used to ship the bicycle to the retail store for reassembly and display, the bicycle can alternatively be retained in the packaging and sold as such to the customer. It is contemplated that the purchaser of the bicycle can easily reassemble the parts that are removed and immediately have a working bicycle with little or no adjustment. While the present invention is typically used to ship bicycles to warehouse-type retailers it also has utility in a variety of other environments, including specialty bicycle stores.

FIG. 5 illustrates the finished product of the method, a bicycle packaged with a minimum of disassembly 5. The packaging 10 is of a minimum size to cover the height, width, and length of the enclosed bicycle with a minimum of wasted room. This allows for the minimum of movement of the bicycle during transport and reduces the chance of damage. The packaging 10 is typically a cardboard box, but is preferably any material which is strong enough to hold the weight of the bicycle without breaking and which will not damage or scratch the bicycle parts.

In general the method requires that the bicycle be fully assembled before packaging, with the exception of the front wheel 30 and the right pedal 100 (see FIGS. 1–5). These bicycle parts are removably, but securely, attached to the bicycle so that the whole assembly, including the removed parts can be lifted out of the packaging 10 as a unit. This reduces the chance of loss. The parts can be attached using anything that attaches securely, but allows for removal without damage. Of particular advantage is something that is easily removable, preferably without the use of an instrument. An example is a wire or twist tie 18. The wire or twist tie 18 is preferably coated in plastic or other protective material.

Figure 2:
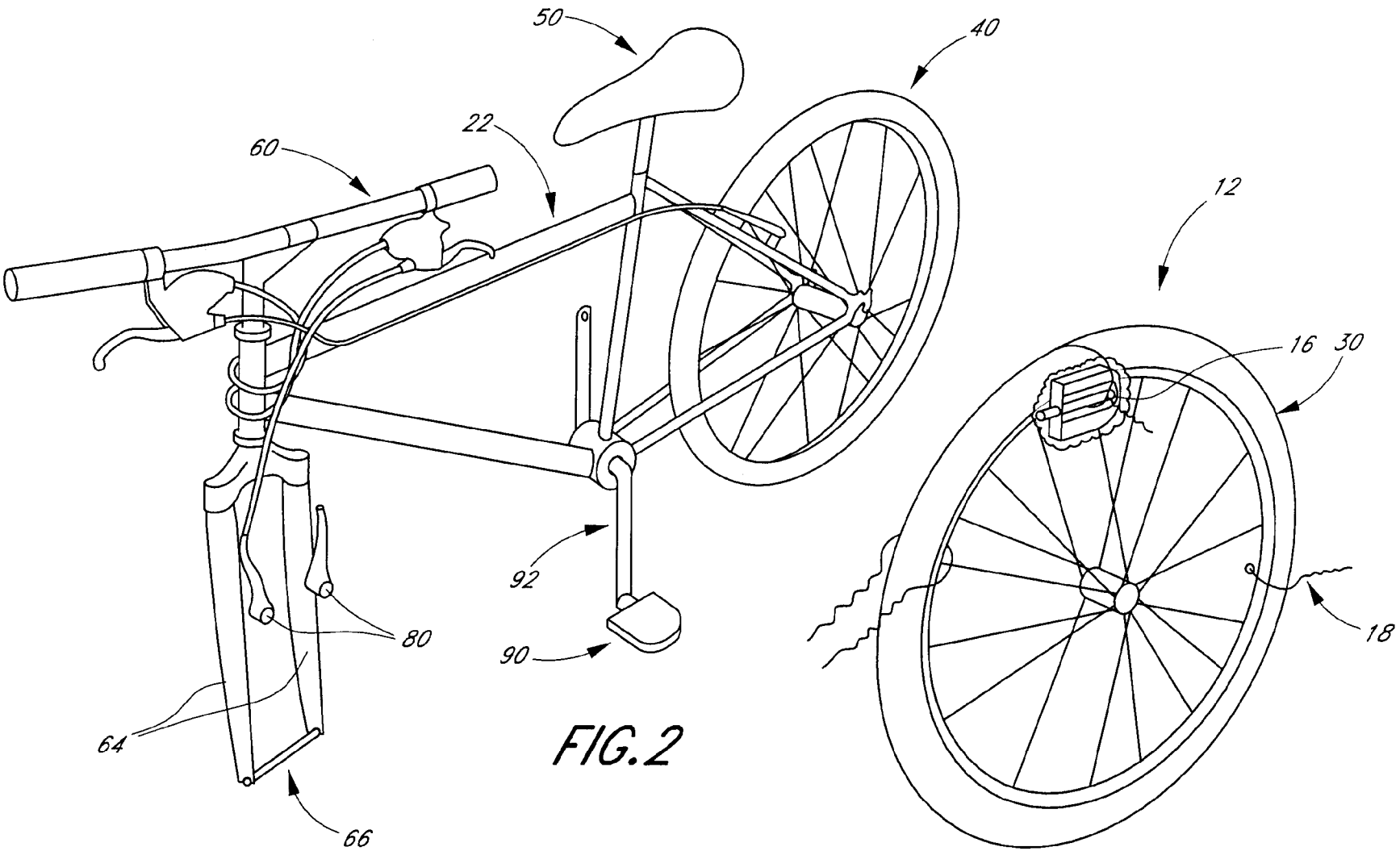
FIG. 2 is the isometric view of the bicycle showing how the tire, packing disk and left pedal are stacked and secured to the frame in accordance with preferred embodiments of the present invention.

With reference to FIGS. 1 and 2, the front wheel 30 is attached along the side of the bicycle with a packing disk 12 inserted between the front wheel 30 and the bicycle frame 22. The packing disk 12 is constructed to be approximately the size of the front wheel 30 and constructed of a material, such as cardboard, which is protective without being damaging. The front wheel 30 and packing disk can be secured in one or a multitude of places. Of interest is that the packing disk 12 cannot shift during transport allowing the front wheel 30 to come in contact with the frame 22. It is contemplated that, for example, twist ties 18 can be pushed through a hole in the packing disk 12 material in a variety of locations around the circumference of the disk and secured to both the front wheel 30 and the frame 22, then twisted around itself securely. The front wheel 30 can advantageously be secured above the left pedal 100, possibly resting on the pedal.

The right pedal 100 is removed and the left crank arm 92 is rotated to the bottom-most position. Alternatively, the left pedal 90 may be rotated so that there is room for the front wheel 30 without increasing the height or width of the packaging 10 needed to enclose the bicycle. The right pedal 100 can be wrapped in a protective material 16 such as plastic or foam and secured to some part of the bicycle. Alternatively it can be secured to the front wheel 30. It is important that the right pedal 100 be affixed in such a way that it does not increase the height, width, or length of the packaging needed to enclose the bicycle.

The right pedal 100 is removed and not the left pedal 90 because the right pedal is more easily reattached to the right crank arm 102 without causing damage. Because the left pedal 90 requires attachment by screwing it on counter-clockwise, a direction that is not intuitive to an unskilled person, it can easily result in the threads being stripped, damaging the bicycle. Therefore, shipping with the left pedal 90 already assembled, insures that there will be the minimum of returns by purchasers who assemble the bicycles at home, and the minimum of damage by unskilled persons assembling the bicycles in a retail store.

A fork insert 66 is attached to the front bicycle fork 64 to keep it from puncturing or going through the packaging. The fork insert 66 removably, but securely attaches to the pronged ends of the fork so that it will not easily be removed by jostling or movement during transport.

The handle bars 60 are positioned by rotating the front fork to align the handlebars along the length of the frame 22. This requires the minimum of width for the packaging 10. The handle bars 60 may be secured in this position with a twist tie 18 or comparable material.

Figure 3:
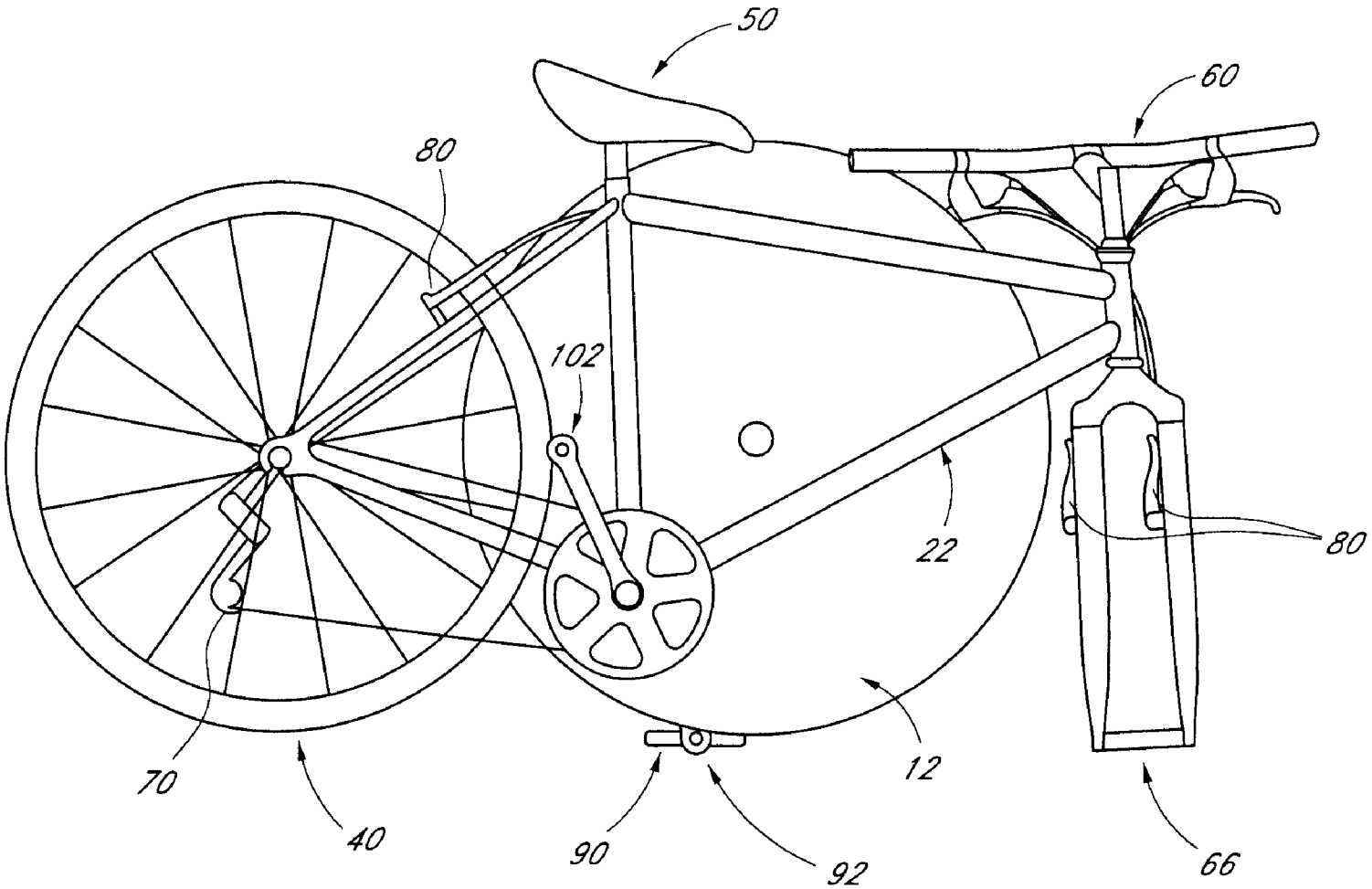
FIG. 3 is a right side view of the bicycle ready for packaging in accordance with the preferred embodiments of the present invention, showing the stacking and fixture of the removed parts.
Figure 4:
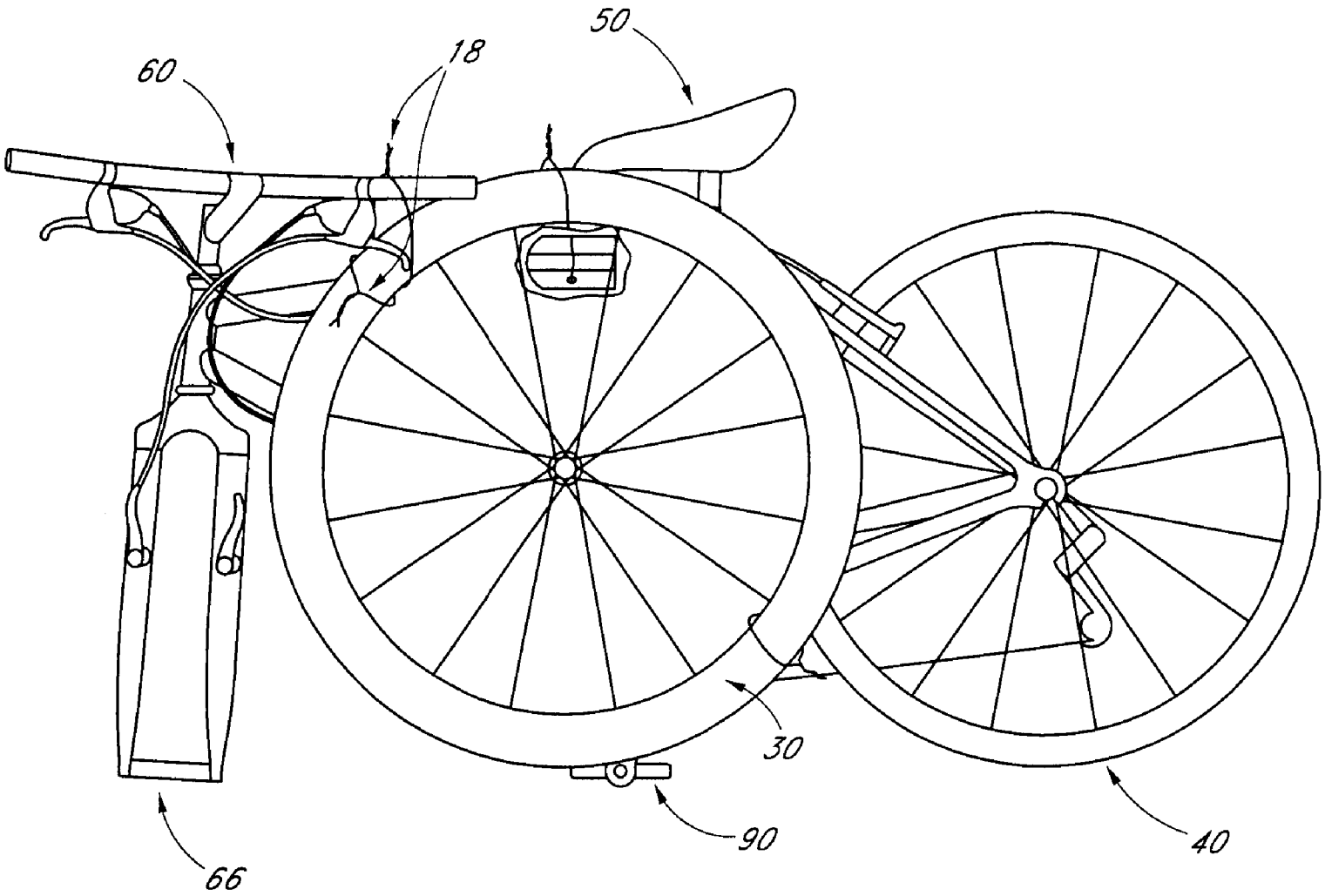
FIG. 4 is a right side view of the bicycle ready for packaging in accordance with the preferred embodiments of the present invention, showing the stacking and fixture of the removed parts.

The derailleur 70 is set to the furthest inside position (see FIGS. 3 and 5). This insures that the minimum of damage due to contact with the packaging 10 and during removal of the bicycle 20 from the packaging 10 will occur.

The saddle 50 can be optionally removed to reduce the height of the necessary packaging 10. It can be wrapped and secured to the bicycle such that the height, length, or width of the assembly are not increased significantly. However, when left in place, the saddle 50 provides a contact point with the packaging 10 and thus protection to the bicycle 20.

It is contemplated that when the bicycle 20 is reassembled, it will require little or no adjustments of the shifting apparatus 70, braking apparatus 80, or derailer 68. This can be accomplished by adjustment of these mechanisms upon the original assembly of the bicycle by the manufacturer. Because the method of packaging requires the removal of few and easily assembled components, the original adjustments will be retained.

When packaged in this way, the bicycle is protected while using a minimum of wrapping materials. With reference to FIG. 5, on the left side of the bike there is one contact point with the box, or packaging material. This is the front wheel 30. Because the front wheel 30 is not easily scratched, it provides protection to the left side of the bicycle 20. On the right side of the bicycle, the contact point is the right crank arm 92 which is not easily scratched so advantageously protects the right side of the bicycle. This is not shown in FIG. 5 due to the slightly right perspective. At the front of the bicycle, the handle bars 60 provide a further contact point with the box. On the top of the box the saddle 50 provides a contact point, and on the bottom, the back wheel 40 and the fork insert 66 provide contact points. All of these contact points are parts of the bicycle which would be hard to damage or scratch, so with a minimum of packing material the bicycle 20 is protected from damage.

It is additionally contemplated that directions for assembly can be printed on the packing disk and/or the box. This would allow an unskilled person to more easily assemble the bicycle correctly.

What is claimed is:

1. A bicycle in a box for shipment, comprising:

a bicycle frame;

right and left crank arms assembled in a proper, working configuration onto said bicycle frame;

one pedal, but not the other, assembled in a proper, working configuration onto one of said right and left crank arms; and a box containing said bicycle.

2. The bicycle in a box of claim 1 wherein said pedal which is assembled in a proper working configuration is the pedal with counter-clockwise threading.

* * * * *